US009217283B2

(12) United States Patent
Olmsted

(10) Patent No.: US 9,217,283 B2
(45) Date of Patent: Dec. 22, 2015

(54) SENSOR DEVICE AND CONTROLLER FOR MOVABLE BARRIER OPERATOR SYSTEMS

(71) Applicant: The Chamberlain Group, Inc., Elmhurst, IL (US)

(72) Inventor: Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 23 days.

(21) Appl. No.: 13/792,710

(22) Filed: Mar. 11, 2013

(65) Prior Publication Data

US 2014/0250787 A1 Sep. 11, 2014

(51) Int. Cl.

| | |
|---|---|
| ***E06B 9/80*** | (2006.01) |
| ***E05F 15/70*** | (2015.01) |
| *E05D 15/24* | (2006.01) |

(52) U.S. Cl.

CPC . *E06B 9/80* (2013.01); *E05F 15/70* (2015.01); *E05D 15/242* (2013.01); *E05Y 2400/44* (2013.01)

(58) Field of Classification Search

USPC ..... 49/13, 322, 26, 28, 197, 199, 200
IPC ..... E06B 9/80,9/82, 9/84; E05F 15/605, E05F 15/70; E05Y 2400/44; E05D 15/242
See application file for complete search history.

(56) References Cited

U.S. PATENT DOCUMENTS

| | | | | |
|---|---|---|---|---|
| 3,012,520 | A * | 12/1961 | Curtis | 104/235 |
| 3,403,474 | A * | 10/1968 | Spasoff | 49/360 |
| 5,310,124 | A * | 5/1994 | Linari et al. | 242/418.1 |
| 5,743,046 | A | 4/1998 | Siegler | |
| 5,826,774 | A * | 10/1998 | Dell'Aglio et al. | 226/44 |
| 6,009,671 | A * | 1/2000 | Sasaki et al. | 49/352 |
| 6,109,017 | A * | 8/2000 | Kawatani | 152/527 |
| 6,782,662 | B2 | 8/2004 | McCartney | |
| 6,895,355 | B2 * | 5/2005 | Fitzgibbon | 702/145 |
| 6,956,199 | B2 | 10/2005 | Smith | |
| 7,042,183 | B2 | 5/2006 | Fitzgibbon | |
| 7,187,150 | B2 | 3/2007 | Robb | |
| RE40,001 | E | 1/2008 | Siegler | |
| 8,115,427 | B2 | 2/2012 | Banta | |

(Continued)

OTHER PUBLICATIONS

Chamberlain LiftMaster Professional Security + Garage Door Opener Model 3800 Owners Manual (C) 2006.

(Continued)

*Primary Examiner* — Gregory Strimbu
(74) *Attorney, Agent, or Firm* — Fitch Even Tabin & Flannery LLP

(57) ABSTRACT

An apparatus having a base portion configured to be secured to a mounting surface and a sensor connected to the base portion that is configured to interface with an elongate member and measure one or more characteristics of the elongate member as the elongate member moves from being wound up on or paid out from a rotatable drive of a movable barrier operator. The one or more characteristics can include, for example, position, velocity, and direction of movement of the elongate member. By measuring the one or more characteristics of the elongate member, corresponding properties of a movable barrier connected to the elongate member can be accurately determined. The apparatus may be also used to supplement an estimate of the properties of the movable barrier obtained from measurement of the rotatable drive and provide a more accurate estimate of the movable barrier properties.

19 Claims, 9 Drawing Sheets

(56) References Cited

U.S. PATENT DOCUMENTS

| | | | | |
|---|---|---|---|---|
| 8,577,627 | B1 * | 11/2013 | Janac et al. | 702/43 |
| 2002/0184824 | A1 * | 12/2002 | McCartney et al. | 49/322 |
| 2004/0006918 | A1 * | 1/2004 | Fitzgibbon | 49/28 |
| 2008/0127560 | A1 * | 6/2008 | Harvey | 49/199 |
| 2012/0097783 | A1 * | 4/2012 | Pack et al. | 242/416 |
| 2012/0145335 | A1 * | 6/2012 | Panseri et al. | 160/2 |

OTHER PUBLICATIONS

Lift-Master, Models 1000 SDR and 2000 SDR Owners Manuals, (C) 1999, 36 pages. See p. 33, elements 9 and 12.

* cited by examiner

SENSOR DEVICE AND CONTROLLER FOR MOVABLE BARRIER OPERATOR SYSTEMS

FIELD

This invention relates to movable barrier operators and, more specifically, devices and methods for determining one or more properties of a movable barrier.

BACKGROUND

Movable barrier operators may be used to control access to areas by moving movable barriers between different positions. Movable barrier operators may estimate properties of the movable barrier such as position and speed by measuring, or deriving from a transmission of the movable barrier operator, the position and speed of an output of the movable barrier operator. However, the estimated properties of the movable barrier may diverge from the actual properties of the movable barrier due to changes in mechanical advantage throughout the path of the movable barrier.

For example, a jackshaft-style movable barrier operator may be installed in a warehouse or garage to control the position of a movable door. The jackshaft operator generally includes an output shaft connected to a counterweight shaft with a torsion spring that lifts most of the weight of the door. To control the position of the door, the jackshaft operator has a drum mounted on the shaft and a cable connected at one end to the drum and at an opposite end to the door. The jackshaft operator can rotate the drum to either wind up or pay out the cable from the drum and generate movement of the door.

The drum of a jackshaft operator may be conical so that a radial distance between the counterweight shaft and the drum surface portion where the cable is being wound up on or paid out from the drum changes as the cable is wound up or paid out. A conical drum may be advantageous in certain applications to provide a different moment arm for the jackshaft operator at different points in the door travel, e.g., the radial distance (and corresponding moment arm) is relatively small at the beginning of door travel when the door is at its heaviest and gradually becomes larger as the door gets lighter toward the end of the door travel. This constantly changing radius makes determining the position of the door based on the position of the output shaft difficult because the distance the door moves with a given amount of shaft rotation changes as the radial distance between the shaft and the drum surface portion (where the cable is being wound up or paid out) varies. Further, the constantly changing radius makes determining the speed of the door based on the speed of the jackshaft operator output shaft difficult because a given speed of rotation of the drum will produce a different speed of the door depending on the position of the door along its path.

Another problem with jackshaft operators is that drums come in a number of different shapes and profiles that allow an installer to select a drum best suited for the barrier and rail system of a particular application. However, from the perspective of a movable barrier operator manufacturer, the shape and profile of a drum that will ultimately be selected by an installer for a particular application is somewhat unknown. Thus, the ability of the movable barrier operator manufacturer to tailor the jackshaft operator to the drum is difficult and the jackshaft operator's understanding of the actual operation of the barrier is therefore less than optimal in some installations. Although the above discussion highlights jackshaft-style operators, the difficulty with estimating the position, speed, or other properties of a movable barrier is equally challenging for other types of movable barrier operators such as trolley style operators.

Figure 1:
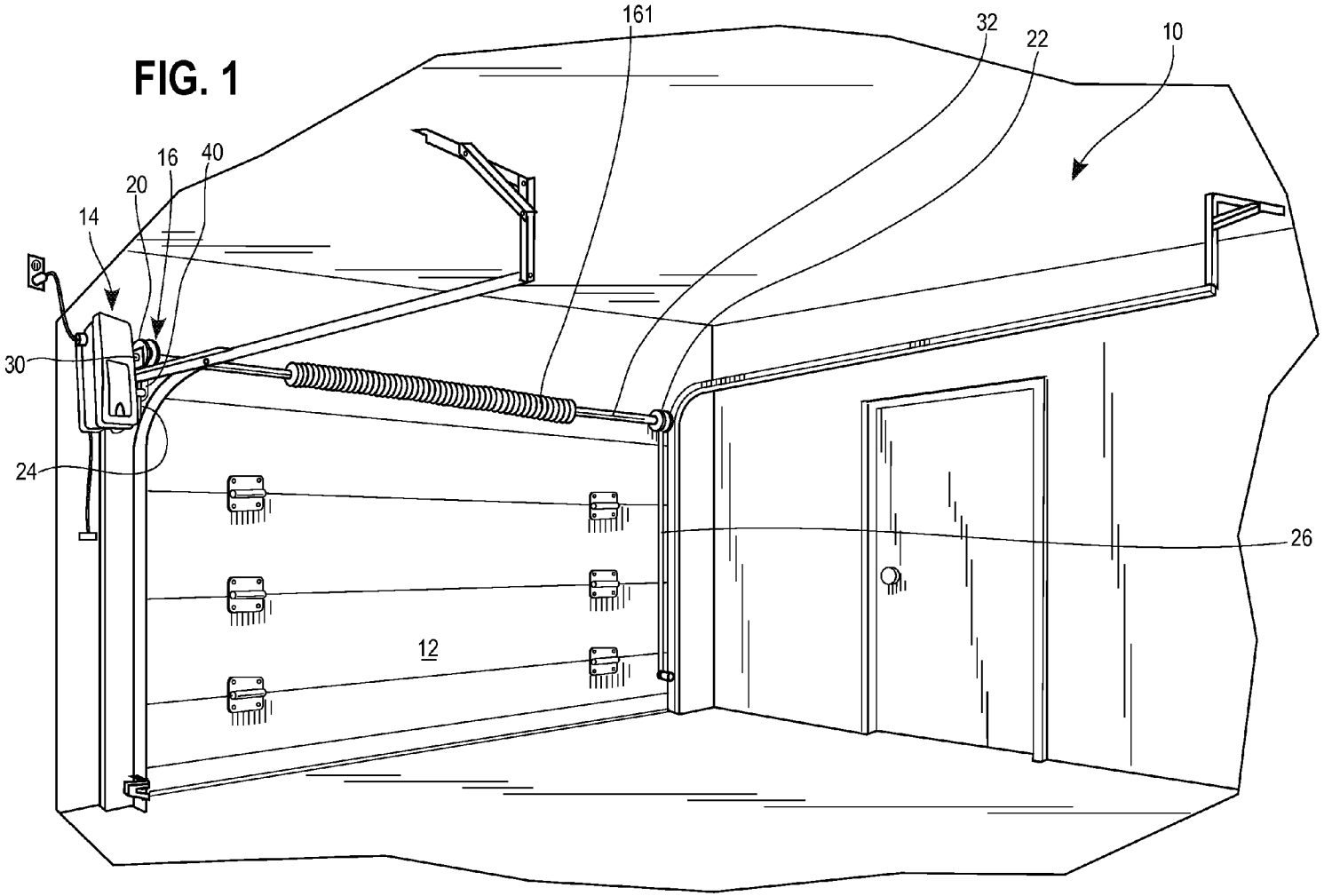
FIG. 1 comprises a perspective view illustrating an installation of an example movable barrier operator system.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking and pursuant to these various embodiments, an apparatus is provided for use with a movable barrier operator having a rotatable drive configured to rotate and cause an elongate member having a length to be wound up on and paid out from the rotatable drive and produce movement of a movable barrier connected to the elongate member. The apparatus has a base portion configured to be secured to a mounting surface and a sensor configured to interface with the elongate member. The sensor is configured to measure one or more characteristics of the elongate member based on movement of the elongate member along the length thereof as the elongate member moves from being wound up on or paid out from the rotatable drive. The one or more characteristics can include the position, velocity, and/or direction of movement of the elongate member, which the movable barrier operator can use to estimate the corresponding position, velocity, and/or direction of movement of the movable barrier. Further, the apparatus can measure the one or more characteristics of the elongate member independently of the behavior of the rotatable drive of the movable barrier operator. In this manner, the information from the apparatus may combined with measurements from the rotatable drive of the movable barrier operator to provide a more accurate estimate of one or more properties of the movable barrier. In one form, the sensor is further configured to measure tension of the elongate member based upon movement of the elongate member in a direction transverse to the movement of the elongate member along the length thereof. This permits the apparatus to both measure the one or more characteristics of the elongate member and provide information regarding the tension of the elongate member, such as the occurrence of a loss-of-tension event, in one cost-effective device.

The sensor may also comprise a rotatable portion configured to contact the elongate member and be rotated with movement of the elongate member in a direction along the length of the elongate member. The sensor is configured to measure the one of more characteristics of the elongate member based at least in part upon rotation of the rotatable portion. By measuring the rotation of the rotatable portion caused by the elongate member, the apparatus can provide direct measurement of the one or more characteristics of the elongate member to the movable barrier operator using an easy to install interface between the rotatable portion and the elongate member.

An apparatus is also provided including a movable barrier operator configured to move a driven member in a forward direction for moving a movable barrier toward a first position and in a reverse direction for moving the movable barrier toward a second position. The apparatus has a device with a detection portion configured to sense tension and at least one other characteristic of the driven member and a signaling portion configured to generate a signal in response to sensing the at least one characteristic of the driven member. The apparatus further includes a movable barrier operator controller configured to determine one or more properties of the movable barrier based at least in part upon the signal from the signaling portion of the device. Utilizing the signal from the signaling portion of the device, the movable barrier operator controller can make a more accurate determination of the one or more properties of the movable barrier than by estimating the one or more properties of the movable barrier based solely upon the position or speed of a transmission of the movable barrier operator, as in some prior approaches.

In another aspect, a method of operating a movable barrier operator is provided herein. The method includes moving a driven member in a forward direction, measuring tension and at least one other characteristic of a driven member, determining the position of a movable barrier based on the characteristic of the driven member, and sensing a change in the tension of the driven member as the driven member moves in the forward direction. The method further includes indicating that the position of the movable barrier determined from the characteristic of the driven member may be compromised in response to sensing the change in tension of the driven member. One application of this approach is in the event the movable barrier strikes an object while closing. The post-strike position of the movable barrier determined from the characteristic of the driven member could be flagged or otherwise indicated as possibly being compromised due to the collision. Further, the movable barrier may indicate a service call should be made to an authorized repair service or may initiate contact with a repair service on its own, such as by sending an error report to a preselected repair service.

Referring now to the drawings and, in particular, to FIG. 1, an example environment for a movable barrier operator system will now be presented. A movable barrier operator system 10 is configured to move a movable barrier, such as garage door 12, between open and closed positions. The movable barrier operator system 10 includes a movable barrier operator 14 having a rotatable drive 16 connected to a pair of drums 20, 22. Rotation of the rotatable drive 16 causes drive members, such as cables 24, 26, to be paid out from or wound up on the drums 20, 22. In other embodiments, the rotatable drive 16 may include one or more drums and the drive members may include other elongate members such as tape, rope, chain, belt, or combinations thereof.

The cables 24, 26 each have a pair of opposed ends, with one end connected to a respective one of the drums 20, 22 and the other end connected to the door 12. Winding the cables 24, 26 onto the drums 20, 22 moves the door 12 toward an open position and paying out the cables 24, 26 from the drums 20, 22 moves the door 12 toward the closed position. In the illustrated example, the movable barrier operator 14 is a jack-shaft-style operator having a jack shaft 30 connected to a counterweight shaft 32 (see FIG. 2) on which the drums 20, 22 are mounted, although the subject matter described herein can be applied to a variety of other movable barrier operators.

Figure 2:
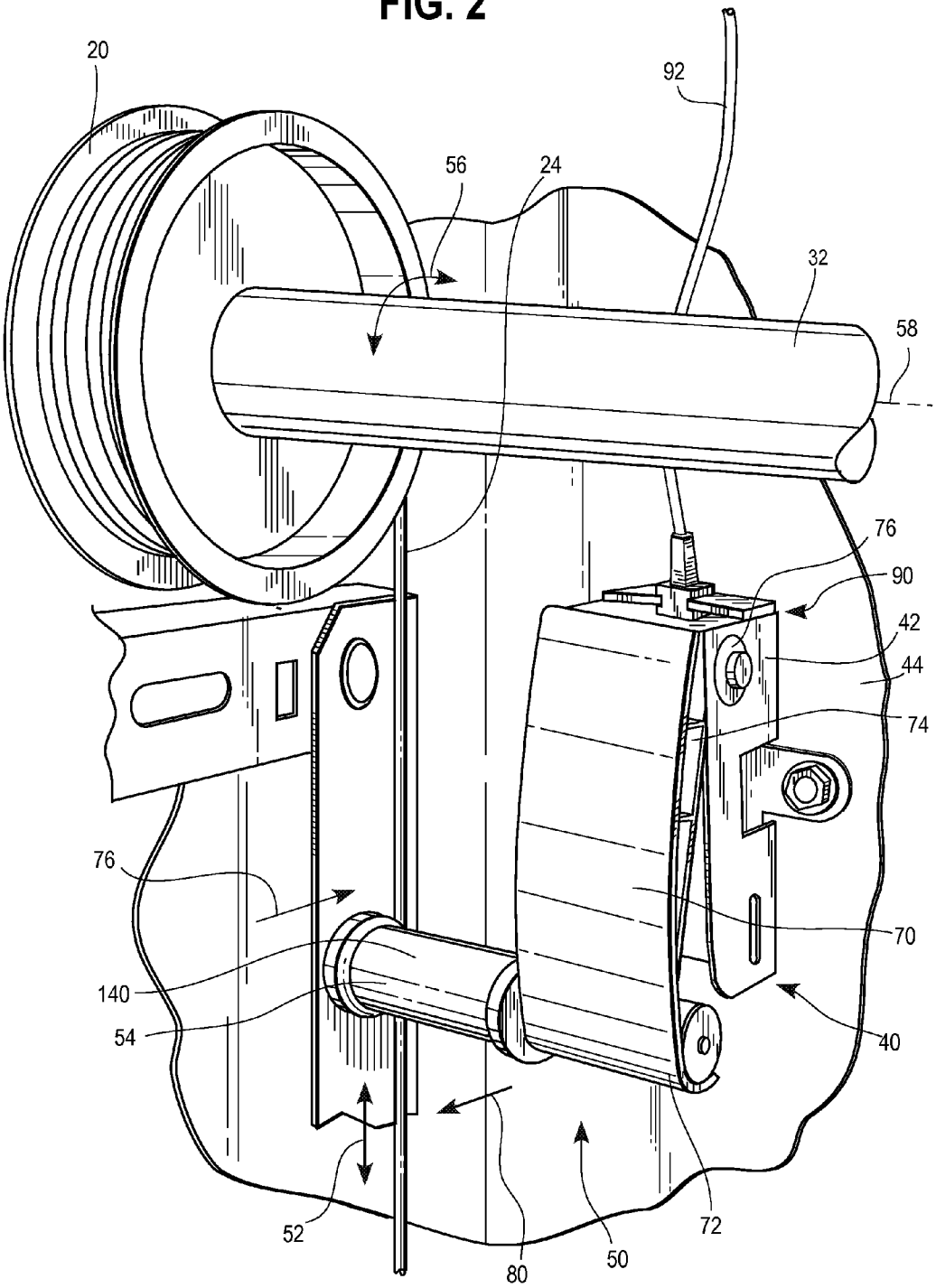
FIG. 2 comprises a perspective view of an example elongate member sensor device of the movable barrier operator system of FIG. 1.

With reference to FIG. 2, the movable barrier operator system 10 has an example elongate member sensor device 40 with a base portion 42 secured to a mounting surface 44 near the drum 20 and a sensor portion 50 that is configured to interface with the cable 24. The sensor portion 50 is configured to measure one or more characteristics of the cable 24 based on movement of the cable 24 in a direction 52 along the length of the cable 24 as the cable 24 moves from being wound up on or paid out from the drum 20 due to rotation of the drum 20 in direction 56 about the axis 58 of the counterweight shaft 32. The one or more characteristics of the cable 24 may include position, velocity, acceleration, and/or direction of movement of the cable 24. Because the cable 24 is connected at one end to the door 12, measuring the one or more characteristics of the cable 24 permits an accurate estimation of one or more properties of the door 12, such as position, velocity, direction of movement, and/or acceleration of the door 12. In the illustrated example, the sensor portion 50 includes a rotatable portion or spool 54 that contacts the cable 24 and rotates as the cable 24 travels back and forth in the direction 52.

The elongate member sensor device 40 has an idler member 70 with a distal portion 72 connected to the sensor portion 50 and a proximal portion 74 connected via a pivot connection 76 to the base portion 42. The pivot connection 76 has a torsion spring that biases the idler member 70 and spool 54 connected thereto toward the mounting surface 44 to keep the rotatable spool 54 engaged and in contact with the cable 24, as shown in FIG. 2. In some instances, the cable 24 may lose tension such as when the movable barrier operator 14 moves the door 12 toward a closed position and the door 12 strikes an object before reaching the closed position. This loss of tension of the cable 24 allows the idler member 70 to pull the cable 24 toward the mounting surface 44 due to the torsion spring pulling the slack in the cable 24 created by continued rotation of the drum 20 as the movable barrier operator 14 attempts to close the door 12.

Figure 3:
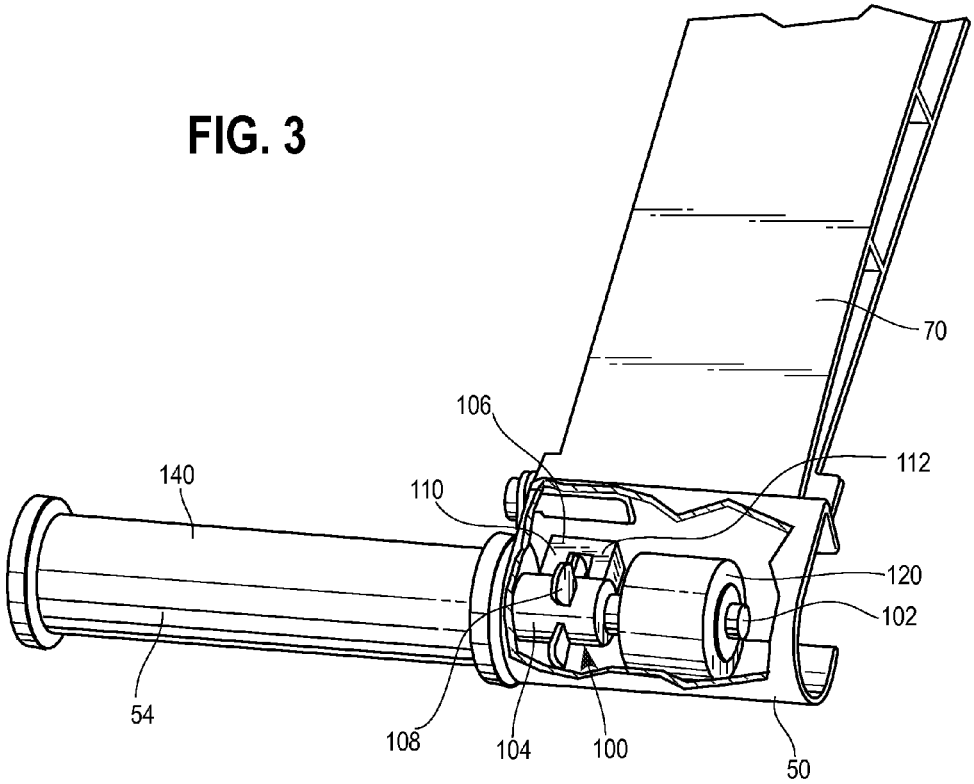
FIG. 3 comprises a partially fragmented perspective view of an example sensor portion of an elongate member sensor device.

Eventually, the inward movement of the idler member 70 triggers a switch to indicate a change in tension of the cable 24, as shown in FIG. 3. In one form, the switch is connected to a lower wall of the idler member 70 and has three positions. When the cable 24 is under normal operating tension, the idler member 70 is slightly pivoted such that the idler member 70 is oriented to extend obliquely relative to the mounting surface 44 (see FIG. 12). The switch is in an intermediate, open position when the cable 24 is under normal tension load and the idler member 70 is in the predetermined partially pivoted orientation. It is noted that the idler member 70 may pivot slightly with ordinary movement of the cable 24 produced during opening and closing of the door 12. A loss in tension in the cable 24, and the associated pivoting of the idler member 70 toward the mounting surface 44, reconfigures the switch to a first closed position. Alternatively, if the cable 24 is pulled away from the mounting surface 44 in direction 80 (see FIG. 2) beyond normal operating tolerances, such as due to an accident or other event, the idler member 70 pivots toward away from the mounting surface 44 and can be designed to reconfigure the switch to a second closed position. When the switch is in either of the closed positions, the elongate member sensor device 40 sends a signal to the movable barrier operator 14 indicating a change of tension event, as will be discussed in greater detail below. The movable barrier operator 14 may reverse the rotation of the drum 20 to move the door 12 back toward the open position in response to this change-of-tension signal from the switch of the elongate member sensor device 40.

The signaling portion 90 of the sensor device 40 is configured to transmit information regarding the one or more characteristics measured from the cable 24 to the movable barrier operator 14, as shown in FIG. 1. The signaling portion 90 also transmits the signal from the switch 79 within the device 40 regarding the tension of the cable 24. The signaling portion 90 is shown with a wired connection 92 for transmitting information to the movable barrier operator 14. It will be appreciated that other approaches, such as radio or wireless transmission, may be used to transmit information to the movable barrier operator 14.

Figure 4:
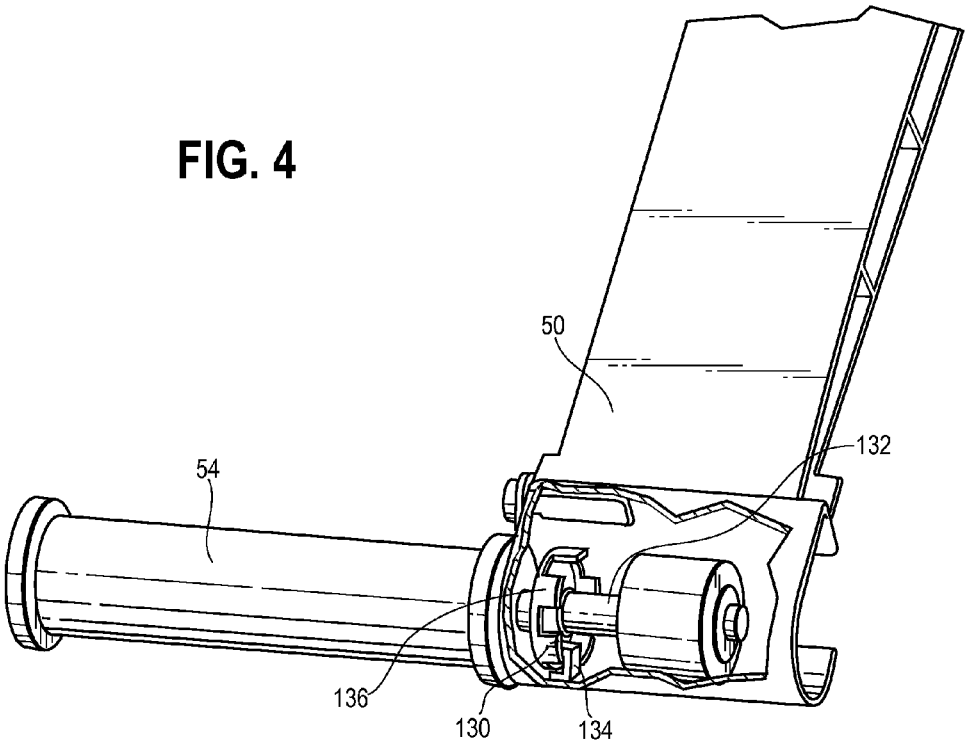
FIG. 4 comprises a partially fragmented perspective view of another example of a sensor portion of an elongate member sensor device.

With reference to FIGS. 3 and 4, examples of the sensor portion 50 are shown in partial fragmentary view to illustrate various components of the examples. With reference to FIG. 3, the sensor portion 50 includes an optical interrupter detection device 100, a shaft 102 connected to the spool 54, and a segmented wheel 104 mounted on the shaft 102. The detection device 100 has an optical sensor 106 that generates an optical beam between portions 110, 112 of the optical sensor 106. Rotation of the spool 54 due to movement of the cable 24 in direction 52 produces rotation of the segmented wheel 104 and causes radial projections 108 of the segmented wheel 104 to rotate between the portions 110, 112 of the optical sensor 106 and interrupt the optical beam. The detection device 100 detects these interruptions to the optical beam and sends signals representative of the interruptions to the movable barrier operator 14 via the signaling portion 90 of the elongate member sensor device 40. The movable barrier operator 14 is configured to utilize the signals from detection device 100 to determine, for example, position, velocity, direction of movement, and/or acceleration of the spool 54 and cable 24 engaged therewith. The sensor portion 50 further includes a bearing 120 for supporting the shaft 102 within the distal portion 72 of the idler member 70 and permitting the shaft 102, spool 54, and segmented wheel 104, to rotate freely due to movement of the cable 24 in direction 52.

Another example of the sensor portion 50 is shown in FIG. 4. In this example, there is a sprocket wheel 130 mounted on a shaft 132 connected to the spool 54. Like the sensor portion 50 of FIG. 3, the sensor portion 50 of FIG. 4 has an optical sensor 134 that measures interruptions of an optical beam due to rotation of axial projections 136 of the sprocket wheel 130. Although shown in FIGS. 3 and 4 as including an optical interrupter, the sensor portion 50 may utilize other devices for sensing properties of a shaft connected to the spool 54. For example, a rotary switch, capacitive sensor, variable resistor, reluctance detector, magnetic detector, or other forms of optical detection may be used to sense properties of a shaft connected to the spool 54. In one approach, the sensor portion 50 may detect the speed, direction, and position of the spool 54 and the cable 24 engaged therewith using a quadrature detection method (see generally U.S. Pat. No. 8,115,427). In yet another approach, the sensor portion 50 may sense properties of the spool 54 directly.

Figure 5:
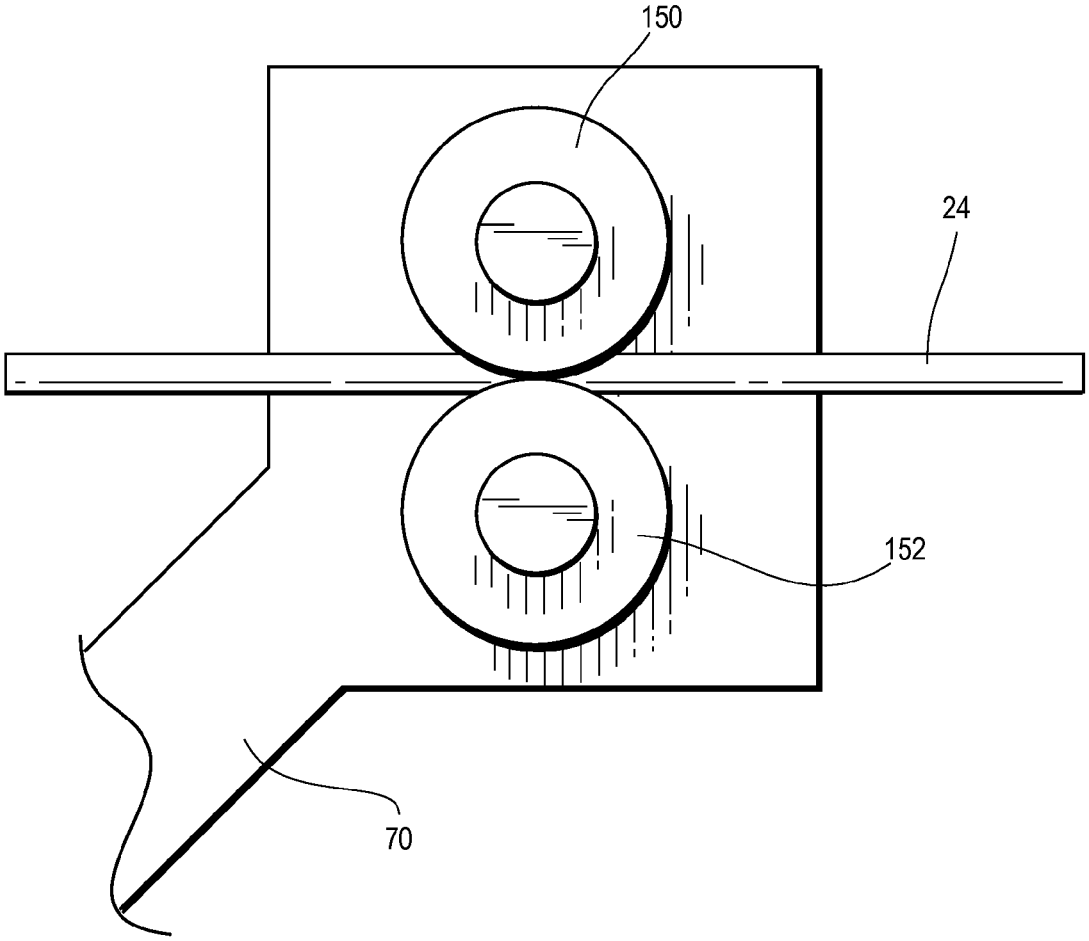
FIG. 5 comprises an elevational view of another example of a sensor portion of an elongate member sensor device.

The sensor portion 50 of the elongate member sensor device 40 may interface with the cable 24 in a number of different ways. In one approach, the interface is a frictional engagement between an outer surface of the cable 24 and a cylindrical surface 140 of the spool 54, as shown in FIG. 2. The material of the spool 54 and/or the characteristics of the surface 140 may be selected to limit slip between the cable 24 and the spool 54 to allow an accurate measurement of the one or more characteristics of the cable 24. For example, the spool 54 can be made of neoprene. With reference to FIG. 5, the interface between the sensor portion 50 and the cable 24 could alternatively utilize a pair of rotatable members 150, 152 disposed on opposite sides of the cable 24. In another approach, the interface between the cable 24 and the sensor portion 50 can be formed by wrapping the cable 24 around the spool 54 to form a loop of the cable 24 around the spool 54.

Figure 6:
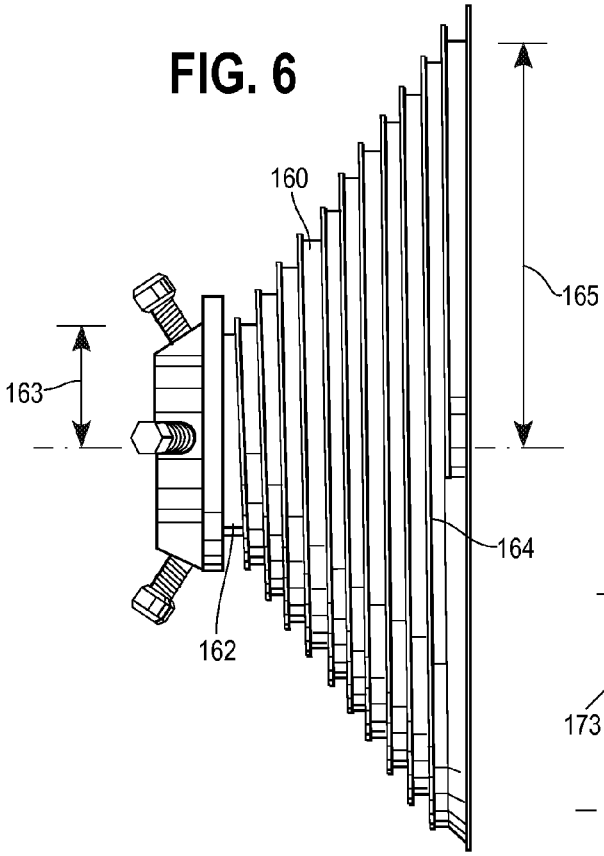
FIG. 6 comprises an elevational view of an example drum that may be used in conjunction with the movable barrier operator system.

In some applications, the movable barrier operator 14 may be connected to a drum 160 having a configuration as shown in FIG. 6. An end of the cable 24 is connected to a startup portion 162 of the drum 160 having a relatively small radius 163, which reduces the moment arm imparted to the drum 160 by the weight of the door 12. The relatively small radius 163 of the drum startup portion 162 and associated smaller moment arm makes it easier to lift the door 12 from the closed position where the counterweight spring 161 (see FIG. 1) provides the least amount of upward force on the door 12 and the door 12 is at its heaviest. The outer surface of the drum 160 gradually increases in radius until reaching a lock out portion 164 having a relatively large radius 165 configured to inhibit drift of the door 12 away from the open position. Due to the relatively large radius 165 of the lock out portion 164, a given distance of movement of the door 12 away from the open position causes the drum 160, and jackshaft 30 of the movable barrier operator 14 connected thereto, to turn a greater amount than if the radius 165 of the lock out portion 164 was smaller. This greater amount of turning reduces the distance the door 12 can drift away from the open position before the transmission of the movable barrier operator 14 restricts further movement of the door 12 by resisting turning of the jackshaft 30. The increasing radius of the drum 160 also accelerates the speed of the door 12 as the door 12 travels toward the open position.

Figure 7:
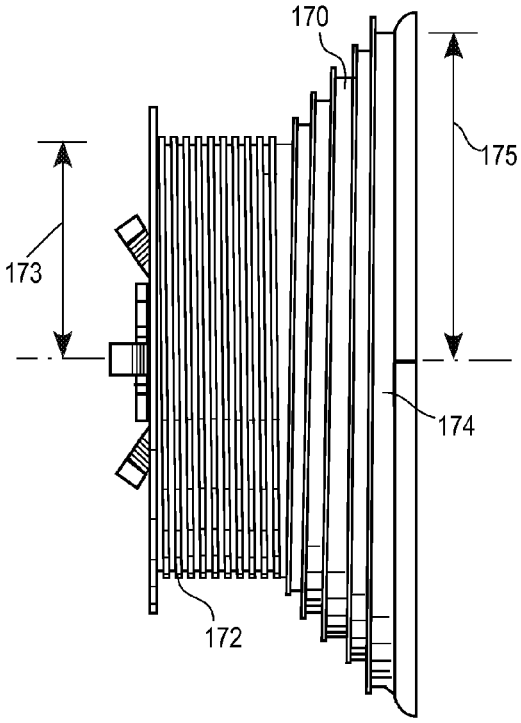
FIG. 7 comprises an elevational view of an example drum that may be used in conjunction with the movable barrier operator system.
Figure 8:
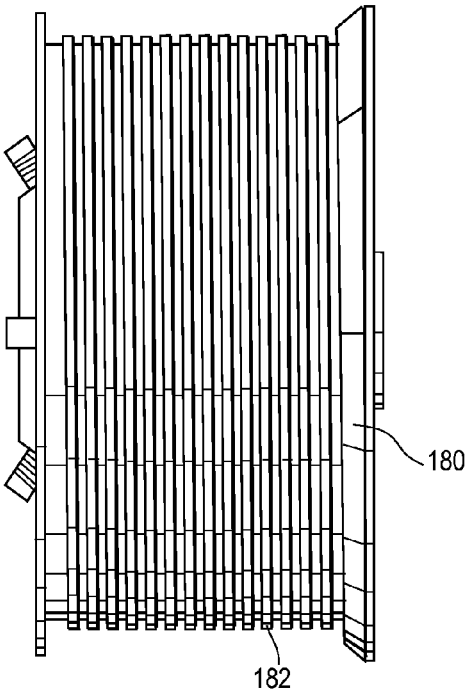
FIG. 8 comprises an elevational view of an example drum that may be used in conjunction with the movable barrier operator system.

Similarly, as illustrated in FIG. 7, a drum 170 may be used having a cylindrical start up portion 172 with a generally constant radius 173 and resulting generally constant moment arm throughout a majority of the travel of the door 12. The drum 170 also has a radially enlarged lock out portion 174 with a relatively larger radius 175 which, like the lock out portion 164, inhibits drift of the door 12 away from the open position and accelerates movement of the door 12 as the door travels toward the open position. In another example illustrated in FIG. 8, the movable barrier operator may be installed with a drum 180 having a generally constant radius body 182 configured to maintain a generally constant moment arm and speed of the door 12 throughout its range of motion.

Figure 9:
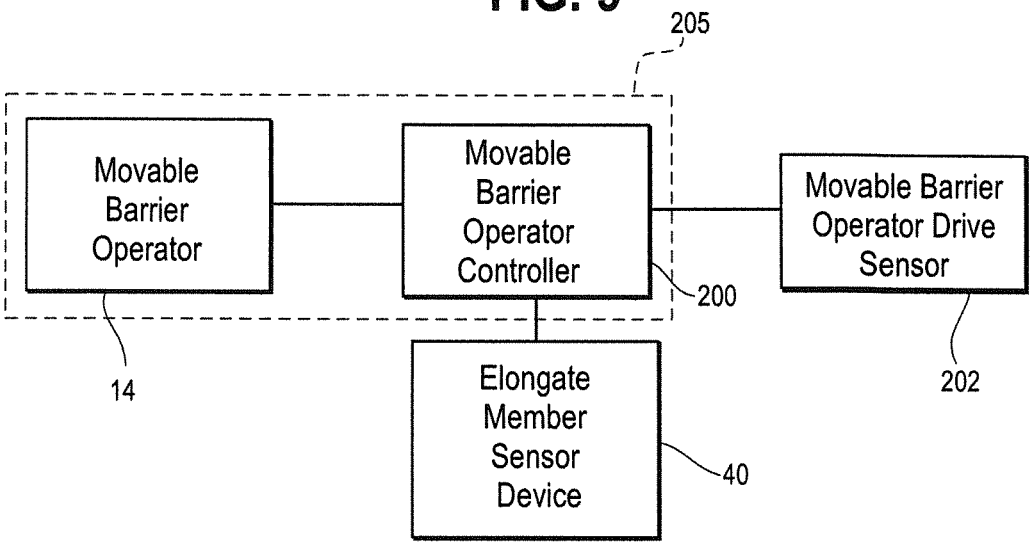
FIG. 9 comprises a conceptual illustration of an example movable barrier operator system including an elongate member sensor device.

A simplified schematic view of a portion of the movable barrier operator system 10 is shown in FIG. 9. The movable barrier operator 14 is connected to a movable barrier operator controller 200, which may be integrated with (see box 205) or separate from the movable barrier operator 14. The movable barrier operator controller 200 is configured to receive signals from the elongate member sensor device 40 as well as a movable barrier operator drive sensor 202. The movable barrier operator drive sensor 202 may be a conventional sensor that detects position, velocity, and direction of movement of an output drive or transmission of the movable barrier operator 14. Examples of such sensors can be found in U.S. Pat. Nos. 6,895,355 and 6,956,199.

Figure 10:
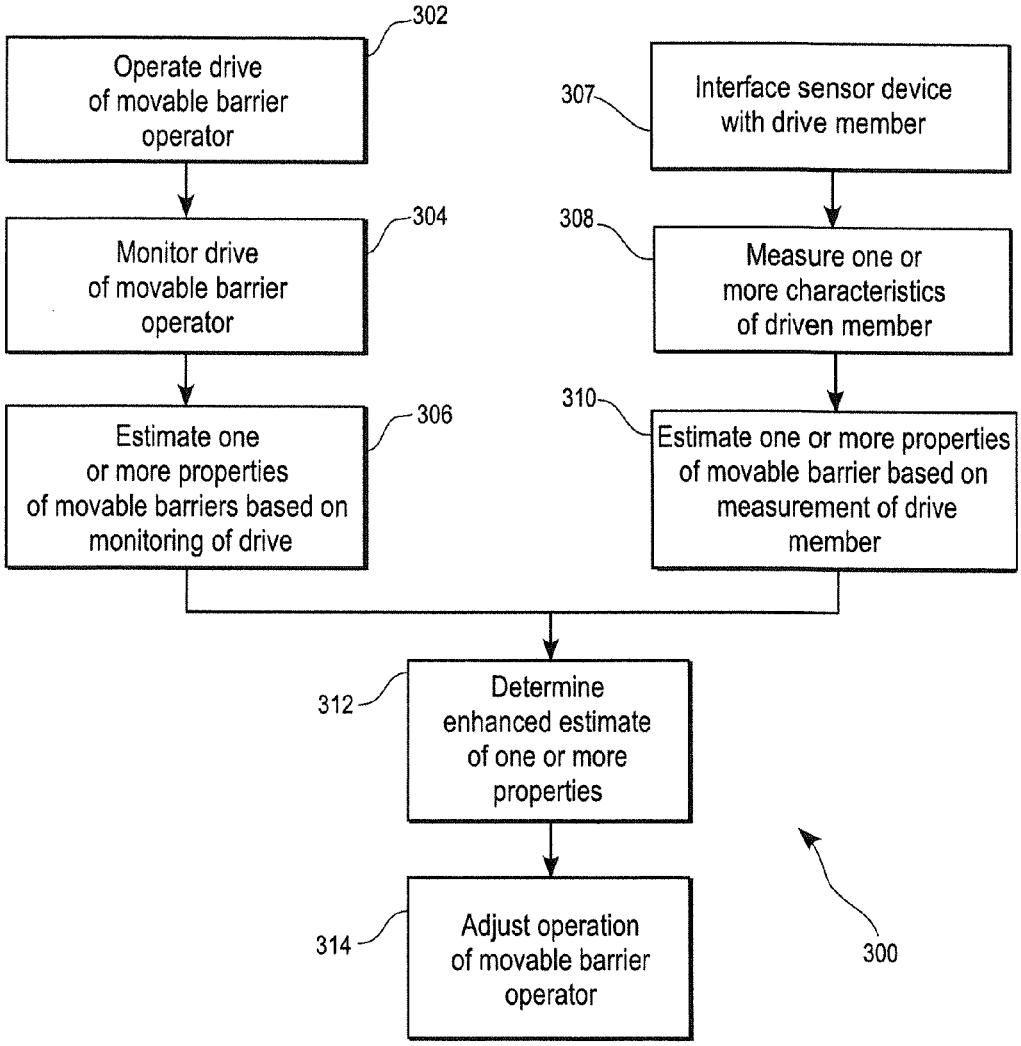
FIG. 10 comprises a flow diagram of an example method of operation of a movable barrier operator in accordance with various embodiments of the invention.

With reference to FIG. 10, an example method 300 of operating the movable barrier operator 14 is disclosed. The method 300 permits the movable barrier operator controller 200 to monitor and control the properties of the door 12 with greater knowledge of the actual properties of the door 12 than conventional approaches. Initially, the movable barrier operator 14 is operated 302 to move the door 12 connected thereto. Operating 302 the movable barrier operator 14 includes turning the rotatable drive 16 to cause the cables 24, 26 to be wound up on or paid out from the drums 20, 22 and produce corresponding movement of the door 12. In another form, operating 302 may include turning a drive gear of a movable barrier operator and advancing a chain to produce corresponding movement of an attached gate. As another example, the method 300 may be utilized with a non-rotatable drive, wherein operating 302 involves energizing a linear actuator to shift a drive member and a movable barrier connected thereto.

The method further includes monitoring 304 the rotatable drive 16 of the movable barrier operator 14. Monitoring 304 the rotatable drive 16 is performed using the movable barrier operator drive sensor 202. As discussed above, the drive sensor 202 is configured to measure at least one of the position, direction of movement, and speed of the rotatable drive 16. For example, with reference to FIGS. 1 and 9, the drive sensor 202 may be disposed within the movable barrier operator 14 and configured to measure the position of the jackshaft 30. Monitoring 304 may be performed as part of a standard feedback control system for a motor of the movable barrier operator 14, or could be a stand-alone operation performed in addition to the standard control processes of the movable barrier operator 14.

Next, one or more properties of the door 12 are estimated 306 based at least in part on the monitoring 304 of the rotatable drive 16. The movable barrier operator controller 200 preferably performs the estimating 306 to provide a generally self-contained and easy-to-install system. In other forms, the estimating 306 may be performed locally such as by communicating with a control system generally at the same geographic location as the movable barrier, or could be performed off-site such as by a remote computer at a movable barrier operator manufacturer.

The estimating 306 can include estimating position, velocity, direction of movement, and/or acceleration of the door 12 based at least in part on the monitoring of the rotatable drive 16 of the movable barrier 14. For example, the portions of the drums 20, 22 about which the cables 24, 26 are wound may be approximated as having an average radius of three inches. If the sensor 202 detects that the jackshaft 30 has rotated one full revolution, which produces a corresponding full revolution of the drums 20, 22, the movable barrier operator 200 could estimate the distance the door 12 traveled by computing:

$$\text{Travel}_{Door}=2\times\Pi\times R_{AverageDrumRadius}$$

The controller 200 would therefore estimate the door 12 had traveled approximately 18.85 inches in response to one rotation of the jackshaft 30. Although the foregoing example is relatively simple, it will be appreciated that estimating properties of the door 12 based upon measurements from the jackshaft 30 can present problems in terms of changing geometries due to operation of the movable barrier operator 14. This difficulty is heightened with irregularly shaped drums (e.g., drums 160 and 170 in FIGS. 6 and 7) and variations in the types of drums that could potentially be installed for a given application.

The estimation 306 of the one or more properties of the door 12 can be enhanced by interfacing 307 the sensor device 40 with the cable 24 (see FIG. 2). Interfacing 307 includes placing the spool member 54 near the cable 24 and permitting the spring 77 to bias the spool member 54 into engagement with the cable 24. In another approach, interfacing 307 could include maneuvering the cable 24 into position between rotatable members 150, 152 (see FIG. 5).

Next, the movable barrier operator controller 200 measures 308 one or more characteristics of the cable 24 using the sensor portion 50 of the sensor device 40. The one or more characteristics measured can include position, velocity, direction of movement, acceleration, and/or tension of the cable 24. As discussed in greater detail below, the interfacing 307 and measuring 308 provides a second source of information regarding the position of the door 12 and can be used to supplement the estimation 306.

Using the measured one or more characteristics of the cable 24, the movable barrier operator controller 200 can estimate 310 one or more properties of the door 12. The estimation 310 is preferably independent of the estimation 306 and may, in some instances, be more accurate because the mechanical relationships underlying the estimation 310 generally do not change with movement of the door 12 along its path of travel. Stated differently, the radius of the spool 54 of the sensor device 40 is fixed such that movement of the cable 24 in direction 52 along the length of the cable 24 produces a generally constant, proportional amount of rotation of the spool 54 that can be sensed by the optical interrupter detection device 100 throughout the range of movement of the door 12 (see FIGS. 2 and 3). By contrast, the estimation 306 is dependent on the rotation of the drum 20 and the resulting movement of the door 12. As discussed above, the diameter of the drum 20 can vary throughout the movement of the door 12 if a partially conical drum such as drum 160 or 170 is used which increases the difficulty of providing an accurate estimate 306. Further, the particular drum selected for an installation can be different than what was anticipated by the movable barrier operator manufacturer. Thus, the estimation 306 of the one or more properties of the door 12 may deviate from the actual one or more properties of the door 12 for a number of reasons.

The movable barrier operator controller 200 determines 312 an enhanced estimate of the one or more properties of the door 12 based upon the estimates obtained at 306, 310. Determining 312 the enhanced estimate can include resolving differences, if any, of the estimates 306 and 310. For example, the estimate 306 of the one or more properties of the door 12 may be more accurate at the beginning of the travel of the door 12, such as when it opens, and the accuracy of the estimate 306 may decrease as the door travels toward the closed position (such as due to changes in drum profile). To account for this decrease in accuracy, the movable barrier operator controller 200 may increase the formulaic weight given to the estimate 310 and decrease the formulaic weight given to the estimate 306 as the door 12 travels toward the closed position.

Next, the movable barrier operator controller 200 may adjust 314 the operation of the movable barrier operator 14 based on the enhanced estimate 312 of the one or more properties of the door 12. For example, if the property of the door 12 being measured is velocity, the movable barrier operator controller 200 may reduce the velocity of the rotatable drive 16 in the event that the estimated velocity of the door 12 exceeds a desired velocity at a particular location of the door 12 along its travel. This feedback-based adjustment allows the movable barrier operator controller 200 to provide a constant velocity of the door 12 along its travel or provide a desired velocity profile of the door 12 along its travel, such as a simple slow start/stop or a full variable speed profile such as a bell curve. In other applications, the method 300 may not utilize the movable barrier operator drive sensor 202 and may instead rely solely upon the elongate member sensor device 40 and steps 308, 310, 312, and 314.

Figure 11:
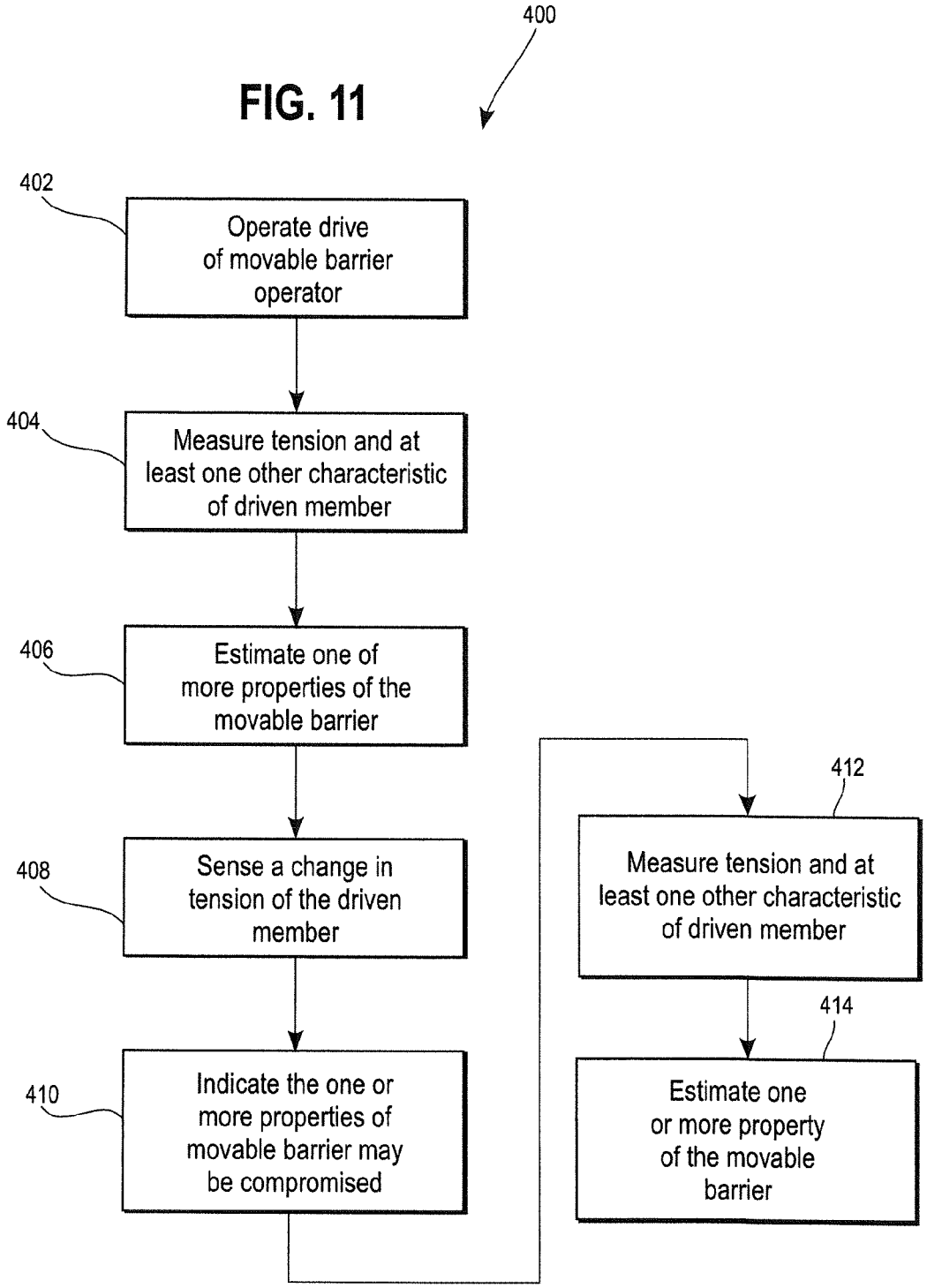
FIG. 11 comprises a flow diagram of an example method of operation of a movable barrier operator in accordance with various embodiments of the invention.

With reference to FIG. 11, a method 400 is shown that utilizes a detection of a change in tension of the cable 24 to indicate a potential decrease in the accuracy of the estimate 310 based on information from the elongate member sensor device 40. The method 400 may be performed in conjunction with the method 300 or may be performed independently of the method 400 according to the desired application.

Figure 12:
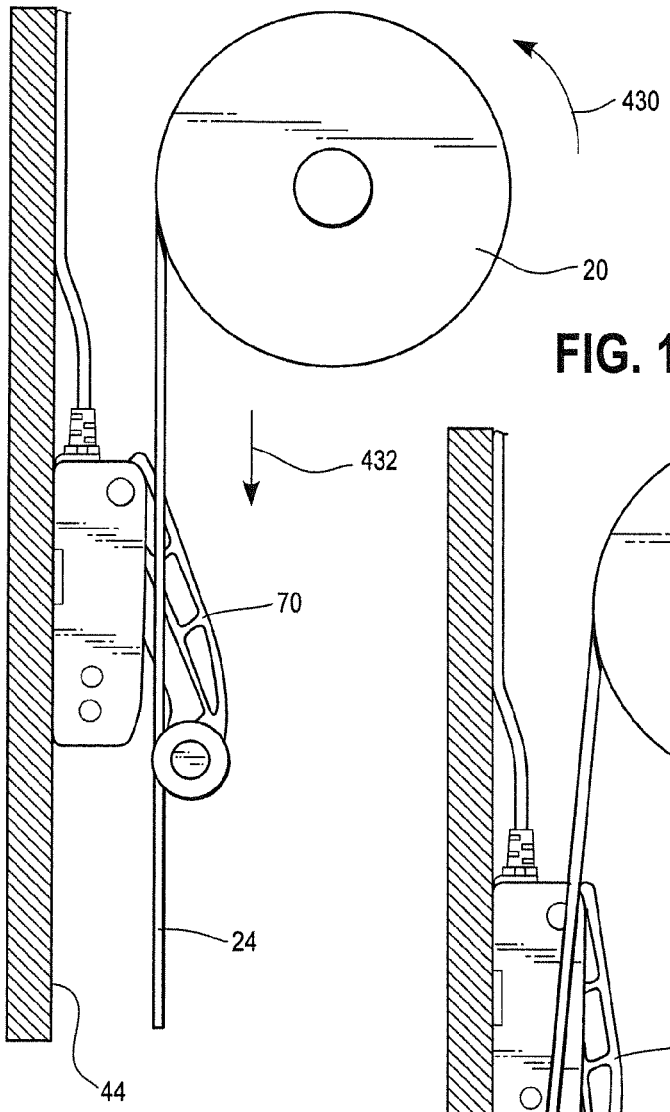
FIG. 12 comprises a side elevational view of a portion of the movable barrier operator system of FIG. 1 including the elongate member sensor device engaged with a cable connected to a drum.

Initially, the movable barrier operator controller 200 operates 402 the rotatable drive 16 of the movable barrier operator 14. For example, the rotatable drive 16 can be operated to turn the drum 20 in direction 430, pay out the cable 24 from the drum 20 in direction 432, and move the door 12 from the open position toward the closed position, as shown in FIG. 12.

The movable barrier operator controller 200 measures 404 tension and at least one other characteristic of the cable 24, such as position, velocity, direction of movement, and/or acceleration, when the door 12 is moving toward the closed position. In one approach, measurement 404 includes sensing the tension in the cable 24 by detecting the position of the switch 79 and sensing the velocity of the cable 24 using the optical interrupter detection device 100 of the sensor portion 50.

Next, the movable barrier operator controller 200 estimates 406 one or more properties of the movable barrier, such as a position, velocity, direction of movement, and/or acceleration of the door 12. The estimation 406 can be based solely on information from the measurement 404 of the cable 24, or can utilize information from both the movable barrier operator 14 and the cable 24 in a manner similar to providing the enhanced estimate 312 in method 300. In another form, the estimation 406 could simply receive the enhanced estimate 312 from the method 300 if method 300 is being performed concurrently.

Figure 13:
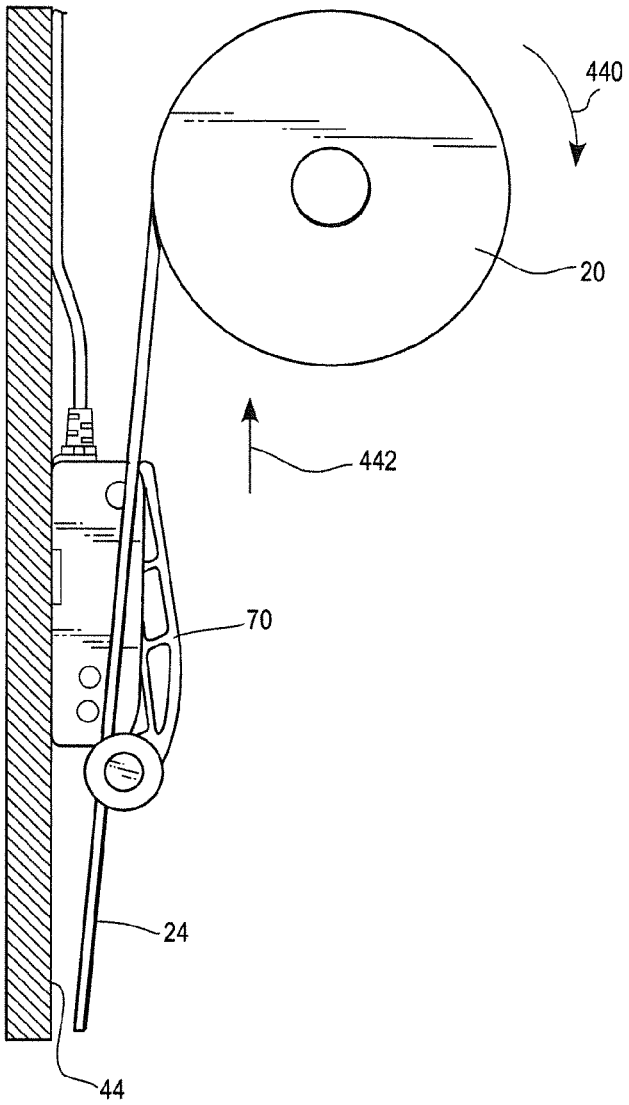
FIG. 13 comprises an elevational view similar to FIG. 12 showing the cable moved due to a tension release event and the corresponding movement of an idler arm of the elongate member sensor device.

The movable barrier operator controller 200 may sense 408 a change in tension of the cable 24, such as when the door 12 strikes an object. With reference to FIGS. 12 and 13, the door 12 striking an object causes tension in the cable 24 to be reduced. The spring 77 of the elongate member sensor device 40 (see FIG. 3) biases the idler 70, spool 54, and cable 24 toward the mounting surface 44, as shown in FIG. 13. This movement of the idler 70 toward the mounting surface 44 reconfigures the switch 79 to the first closed position and causes the sensor device 40 to send a signal, via the transmitting portion 90, to the movable barrier operator controller 200 indicating a change of tension in the cable 24. Alternatively, if so configured, the switch 79 may be set in the second closed position if the idler 70, spool 54, and cable 24 travel a substantial distance away from the mounting surface 44 due to a change in tension in the cable 24. The sensor device 40 can send a signal to the controller 200 indicating the movement of the cable 24 away from the mounting surface 44 and the resulting change in tension of the cable 24.

In response to sensing 408 the change in tension of the cable 24, the movable barrier operator controller 200 can cause the movable barrier operator 14 to rotate the drum 20 in a reverse direction 440 to pull the cable 24 upward in direction 442, wind the cable 24 onto the drum 20, and pull the door 12 back toward the open position, as shown in FIG. 13.

The movable barrier controller 200 then indicates 410 that the one or more properties of the door 12 may be compromised. For example, the movable barrier operator controller 200 may flag the signal from the elongate member sensor device 40 relating to the at least one other characteristic of the cable 24 as potentially being incorrect. This indication or flagging may be useful for the period when the drum 20 is rotating in direction 440 to wind the cable 24 back onto the drum 20 and draw the slack out of the cable 24 after the door 12 has struck the object. The controller 200 may then reduce the weight or importance given to the one or more characteristics determined from the elongate member sensor device 40 until the tension on the cable 24 has been restored and the cable 24 is returned to the operating tension. The resulting return of the cable 24 to its operating tension pivots the idler 70 back to its normal position (see FIG. 12) and reconfigures the switch 79 to the open position, which the movable barrier operator 200 detects as signaling the end of the tension event.

Next, the movable barrier operator controller 200 measures 412 tension and at least one other characteristic of the cable 24, such as position, velocity, direction of movement, and/or acceleration, after sensing 408 the change in tension of the cable 24. This may include measuring the tension and at least one characteristic of the cable 24 as the cable 24 moves in the reverse direction (such as due to rotation of drum 20 in direction 440). The measuring 412 may also include sensing the tension of the cable 24 reaching a predetermined level, such as tension experienced during normal opening and closing of the door 12. The indication 410 or flag may then be removed once the movable barrier operator controller 200 has determined that the cable 24 is back to operating under normal conditions.

The method 400 further includes estimating 414 one or more properties of the movable barrier 12 post-tension event based on the characteristic measured at 412. In one approach, the estimating 414 is performed in response to the tension in the cable 24 reaching a predetermined level after the tension event, such as the tension being within a range typically experienced by the cable 24 during ordinary operation of the movable barrier operator 14. The estimating 414 permits the movable barrier operator controller 200 to estimate post-tension-event properties of the door 12, such as its position, with the normal weight given to the signal from the elongate member sensor device 40.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept. This will also be understood to encompass various combinations and permutations of the various components that have been set forth in these teachings.

What is claimed is:

1. An apparatus for moving a movable barrier between a first position and a second position, the apparatus comprising:

a driven member configured to be connected to the movable barrier;

a movable barrier operator including a rotatable drive configured to be coupled to the driven member, the movable barrier operator rotatable drive configured to move the driven member in a forward direction for moving the movable barrier toward the first position and move the driven member in a reverse direction for moving the movable barrier toward the second position;

a rotatable drive sensor configured to measure at least one characteristic of the rotatable drive;

a device having a detection portion configured to sense tension and at least one other characteristic of the driven member as the driven member moves in the forward or reverse directions and having a signaling portion configured to generate a signal in response to sensing the at least one other characteristic of the driven member; and a movable barrier operator controller configured to be operably coupled to the signaling portion of the device and the rotatable drive sensor, the movable barrier operator controller configured to determine a first estimate of one or more properties of the movable barrier based at least in part upon the signal from the signaling portion of the device and a second estimate of the one or more properties of the movable barrier based at least in part on the at least one characteristic of the rotatable drive, the movable barrier operator controller being further configured to produce an enhanced estimate of the one or more properties of the movable barrier based on the first estimate and the second estimate.

2. The apparatus of claim 1 wherein the one or more properties of the movable barrier include a velocity of the movable barrier.

3. The apparatus of claim 1 wherein the device has a base portion configured to be secured to a mounting surface and the detection portion is connected to the base portion.

4. The apparatus of claim 1 wherein the driven member is an elongated, flexible member and the movable barrier operator rotatable drive comprises a revolving member connected to the driven member with the revolving member configured to rotate about an axis in a first direction to cause the driven member to be wound up onto the revolving member and rotate about the axis in a second direction to cause the driven member to be paid out from the revolving member.

5. The apparatus of claim 4 wherein the at least one other characteristic of the driven member is a velocity of the driven member relative to the detection portion and the detection portion of the device is configured to sense the velocity of the driven member independently of a speed of rotation of the revolving member.

6. The apparatus of claim 4 wherein the detection portion of the device comprises a rotatable member that is configured to contact the driven member and be rotated with the movement of the driven member in the forward and reverse directions along a length of the driven member, and the detection portion of the device is configured to measure a rotational position of the rotatable member.

7. The apparatus of claim 6 wherein the detection portion includes a device selected from the group consisting of:

an optical interrupter, a rotary switch, a capacitive sensor, a variable resistor, a reluctance resistor, a magnetic detector, and combinations thereof.

8. The apparatus of claim 1 wherein the movable barrier operator controller is configured to adjust weights given to the first estimate and the second estimate depending on a position of the movable barrier between the first and second positions.

9. The apparatus of claim 1 wherein the rotatable drive of the movable barrier operator includes a drum having a conical portion and the movable barrier operator is configured to rotate the drum in a first rotary direction to wind the driven member onto the drum conical portion and move the driven member in the forward direction for moving the movable barrier toward the first position and rotate the drum in a second rotary direction to pay out the driven member from the drum conical portion and move the driven member in the reverse direction for moving the movable barrier toward the second position, wherein the drum conical portion causes the driven member and movable barrier connected thereto to have a varying speed as the driven member is wound on or paid out from the drum conical portion.

10. The apparatus of claim 9 wherein the movable barrier operator controller is configured to adjust weights given to the first estimate and the second estimate in response to the varying speed of the driven member.

11. An apparatus for a movable barrier operator having a rotatable drive configured to be coupled to an elongate member and to be rotated to cause the elongate member to be wound on or paid out from the rotatable drive and produce corresponding movement of a movable barrier connected to the elongate member toward first or second positions, the apparatus comprising:

a base portion configured to be secured to a mounting surface;

a detection portion connected to the base portion and configured to interface with the elongate member and measure at least one characteristic of the elongate member based on a movement of the elongate member in a direction along a length thereof as the elongate member moves from being wound on or paid out from the rotatable drive, the at least one characteristic of the elongate member including at least one of position, velocity, and direction of movement of the elongate member;

a signaling portion configured to generate a signal in response to the detection portion measuring the at least one characteristic of the elongate member;

a movable barrier operator controller configured to be operably coupled to the movable barrier operator and the signaling portion, the movable barrier operator controller configured to determine a first estimate of at least one property of the movable barrier based at least in part upon at least one characteristic of the rotatable drive of the movable barrier operator and determine a second estimate of the at least one property of the movable barrier based at least in part upon the signal from the signaling portion, the movable barrier operator controller being further configured to produce an enhanced estimate of the at least one property of the movable barrier based on the first estimate and the second estimate.

12. The apparatus of claim 11 wherein the detection portion includes a rotatable portion for contacting the elongate member and being rotated by the movement of the elongate member along the length thereof, the detection portion being configured to measure the at least one characteristic of the elongate member based at least in part on the rotation of the rotatable portion.

13. The apparatus of claim 11 wherein the detection portion includes a rotatable member for interfacing with the elongate member and an idler member, the idler member having a distal portion to which the rotatable member is rotatably mounted and a proximal portion pivotally connected to the base portion, the detection portion being configured to measure tension of the elongate member based on pivoting of the idler member, the signaling portion being configured to generate a second signal in response to the detection portion measuring the tension of the elongate member.

14. The apparatus of claim 13 wherein the base portion includes a flat surface facing the mounting surface and defining a plane and the pivot connection between the idler member proximal portion and the base portion defines a pivot axis for the idler member that extends substantially parallel to the plane.

15. The apparatus of claim 11 wherein the movable barrier operator controller is configured to adjust weights given to the first estimate and the second estimate depending on a position of the movable barrier between the first and second positions.

16. The apparatus of claim 11 wherein the rotatable drive of the movable barrier operator includes a rotatable drum and rotation of the rotatable drive causes the elongate member to be wound on or paid out from the drum.

17. An apparatus for controlling operation of a movable barrier operator having a rotatable drive and being operably connected to a device, the rotatable drive being configured to be coupled to an elongate member and to be rotated to cause the elongate member to be wound on or paid out from the rotatable drive which produces corresponding movement of a movable barrier connected to the elongate member, the device having a detection portion configured to interface with the elongate member and measure at least one characteristic of the elongate member based on movement of the elongate member in a direction along a length thereof as the elongate member moves from being wound on or paid out from the rotatable drive, the at least one characteristic of the elongate member including at least one of position, velocity, and direction of movement of the elongate member, and the device includes a signaling portion configured to generate a signal regarding the at least one characteristic of the elongate member measured by the detection portion, the apparatus comprising:

a movable barrier operator controller configured to be operably connected to the movable barrier operator and the device signaling portion, the movable barrier operator controller configured to determine a first estimate of at least one property of the movable barrier based at least in part upon at least one characteristic of the rotatable drive of the movable barrier operator and determine a second estimate of the at least one property of the movable barrier based at least in part upon the signal from the device signaling portion, the movable barrier operator controller being further configured to produce an enhanced estimate of the at least one property of the movable barrier based on the first estimate and the second estimate and adjust the operation of the movable barrier operator in response to the enhanced estimate.

18. The apparatus of claim 17 wherein the movable barrier operator controller is configured to adjust weights given to the first estimate and the second estimate depending on a position of the movable barrier.

19. The apparatus of claim 17 wherein the at least one property of the movable barrier is selected from the group consisting of: velocity of the movable barrier; position of the movable barrier; and direction of movement of the movable barrier, and combinations thereof.

* * * * *